US009523363B2

(12) United States Patent
Köck

(10) Patent No.: US 9,523,363 B2
(45) Date of Patent: Dec. 20, 2016

(54) COMPRESSOR FLANGE FOR SCREW-TYPE COMPRESSOR

(75) Inventor: Engelbert Köck, Planegg (DE)

(73) Assignee: KNORR-BREMSE SYSTEME FUR SCHIENENFAHRZEUGE GMBH, Munich (DE)

( * ) Notice: Subject to any disclaimer, the term of this patent is extended or adjusted under 35 U.S.C. 154(b) by 435 days.

(21) Appl. No.: 13/640,920

(22) PCT Filed: Apr. 13, 2011

(86) PCT No.: PCT/EP2011/055754

§ 371 (c)(1),
(2), (4) Date: Dec. 3, 2012

(87) PCT Pub. No.: WO2011/128349

PCT Pub. Date: Oct. 20, 2011

(65) Prior Publication Data

US 2013/0064694 A1 Mar. 14, 2013

(30) Foreign Application Priority Data

Apr. 16, 2010 (DE) ..... 10 2010 015 151

(51) Int. Cl.
*F04C 29/00* (2006.01)
*F04C 18/08* (2006.01)
(Continued)

(52) U.S. Cl.
CPC ..... *F04C 29/00* (2013.01); *F04C 18/086* (2013.01); *F04C 27/006* (2013.01); *F04C 18/16* (2013.01); *F04C 29/0042* (2013.01)

(58) Field of Classification Search
CPC ... F04C 29/005; F04C 2230/60; F04B 39/121; H02K 15/16; H02K 5/15
(Continued)

(56) References Cited

U.S. PATENT DOCUMENTS 2,911,549 A 11/1959 Culk
3,209,990 A 10/1965 Akerman
(Continued)

FOREIGN PATENT DOCUMENTS

CN 101624984 A 1/2010
DE 1044122 B 11/1958
(Continued)

OTHER PUBLICATIONS

International Preliminary Report on Patentability and Written Opinion of the International Search Authority for International Patent Application No. PCT/EP2011/055754, dated Apr. 13, 2011.
(Continued)

*Primary Examiner* — Patrick Hamo

(74) *Attorney, Agent, or Firm* — Barnes & Thornburg LLP

(57) ABSTRACT

A compressor flange for connecting a screw-type compressor to a drive, wherein the compressor flange has a central opening for receiving a shaft and/or a bearing and a first annular bearing face for bearing on a housing of the compressor and a second annular bearing face for bearing on a housing of the drive. The compressor flange also has axially and/or radially effective seals for forming a seal with respect to the compressor housing and/or the shaft, with the result that an open compressor housing can be closed off and sealed by insertion of the compressor flange. The device relates to a screw-type compressor with such a compressor flange.

14 Claims, 1 Drawing Sheet

(51) Int. Cl.
*F04C 27/00* (2006.01)
*F04C 18/16* (2006.01)

(58) Field of Classification Search
USPC ..... 417/410.1, 410.3, 410.4, 423.11, 360, 417/423.6; 310/88, 89
See application file for complete search history.

(56) References Cited

U.S. PATENT DOCUMENTS

| | | | | |
|---|---|---|---|---|
| 3,902,827 | A | 9/1975 | Schibbye | |
| 5,165,872 | A * | 11/1992 | Fleischmann et al. | 417/423.4 |
| 6,471,494 | B1 * | 10/2002 | Miura et al. | 417/410.4 |
| 6,948,919 | B2 * | 9/2005 | Roslund et al. | 417/423.7 |
| 2002/0081150 | A1 | 6/2002 | Pellicano et al. | |
| 2004/0202550 | A1 * | 10/2004 | Kawaguchi et al. | 417/212 |
| 2005/0123415 | A1 | 6/2005 | Hoshino et al. | |

FOREIGN PATENT DOCUMENTS

| | | | | |
|---|---|---|---|---|
| DE | 456 832 | | 5/1967 | |
| DE | 1 428 026 | | 12/1968 | |
| DE | 24 34 404 | A1 | 2/1975 | |
| DE | 7927054.5 | U1 | 9/1979 | |
| DE | 197 16 549 | A1 | 11/1998 | |
| DE | 197 28 434 | A1 | 1/1999 | |
| EP | 0 048 095 | A1 | 3/1982 | |
| EP | 1 207 306 | A2 | 5/2002 | |
| JP | 2005-163713 | A | 6/2005 | |
| WO | WO9715759 | A1 * | 5/1997 | F02B 39/12 |
| WO | 2004/053311 | A1 | 6/2004 | |
| WO | 2008/086991 | A1 | 7/2008 | |
| WO | 2011128349 | A3 | 10/2011 | |

OTHER PUBLICATIONS

English Translation of the International Preliminary Report on Patentability and Written Opinion of the International Search Authority for International Patent Application No. PCT/EP2011/055754, dated Apr. 13, 2011.
Chinese Office Action for Chinese Application No. 201180024305.0 dated Dec. 26, 2014.
Japanese Office Action for Japanese Patent No. 2013-504249 dated Mar. 30, 2015, along with the English translation.

* cited by examiner

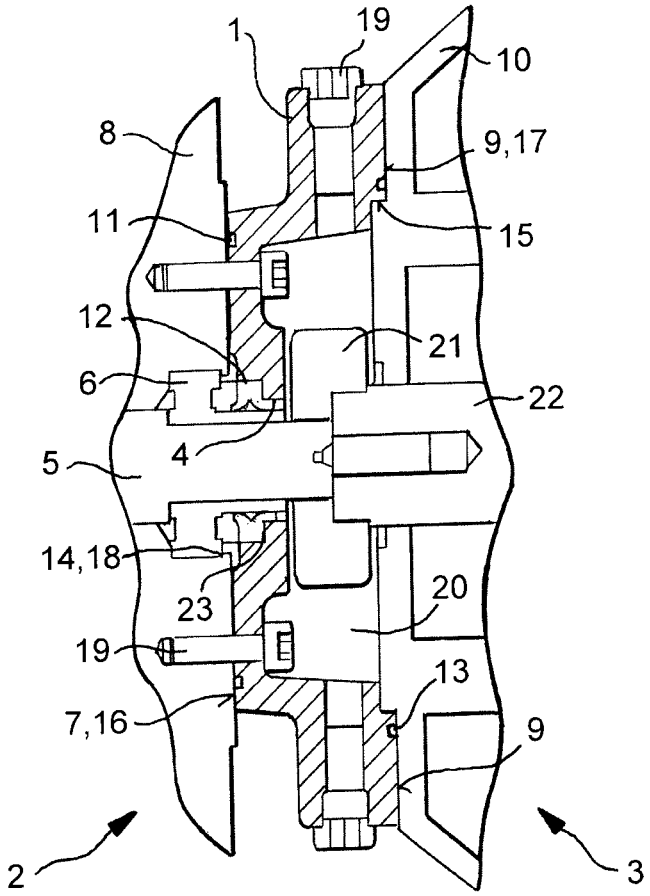
1
19
10
8
9,17
11
15
12
21
6
22
4
5
14,18
23
20
19
13
7,16
9
2
3

COMPRESSOR FLANGE FOR SCREW-TYPE COMPRESSOR

PRIORITY CLAIM

This patent application is a U.S. National Phase of International Patent Application No. PCT/EP2011/055754, filed 13 Apr. 2011, which claims priority to German Patent Application No. 10 2010 015 151.3, filed 16 Apr. 2010, the disclosures of which are incorporated herein by reference in their entirety.

FIELD

Disclosed embodiments relate to a compressor flange for connecting a screw-type compressor to a drive, in particular, to a screw-type compressor having such a compressor flange.

Currently available screw-type compressors have, for connection to a drive, connecting elements which are provided for centering purposes with a centering collar or with centering pins. The connecting elements regularly comprise a connecting flange which is connectable to an end cover of the screw-type compressor. The end cover closes the compressor housing and seals it off outwardly. A plurality of components are therefore regularly required which have to be appropriately positioned and fastened for connecting the screw-type compressor to a drive. The outlay in terms of manufacture and assembly is therefore very high.

BACKGROUND

Laid-open publication DE 10 44 122 A discloses a cold compressor with a horizontally flanged-on electric motor which, in the closed version, comprises a flange component for connecting the compressor to the electric motor. The compressor housing has a hub-like extension for receiving the driveshaft and for receiving a centrically arranged extension of the flange component, so that centering of the flange component takes place while the latter is being inserted. Centering of the compressor with respect to the electric motor is to take place by means of a further annular step formed concentrically to the centric extension. In this case, floating ring shaft sealing is dispensed with, since some leakage is tolerated or is desired. Moreover, a bore is provided in the flange component in order to feed lubricant from the electric motor to the interior of the compressor housing.

SUMMARY

Disclosed embodiments provide a compressor flange for connecting a screw-type compressor to a drive, which compressor flange requires low outlay in terms of manufacture and assembly and combines a plurality of functions in one component.

Disclosed embodiments provide a means of a compressor flange and a screw-type compressor having such a compressor flange.

BRIEF DESCRIPTION OF THE FIGURES

Disclosed embodiments are explained in more detail below by means of the single FIGURE, which shows the disclosed compressor flange bearing against a compressor housing and against a housing of a drive.

DETAILED DESCRIPTION

The specified compressor flange for connecting a screw-type compressor to a drive has a central orifice for the reception of a shaft and/or of a bearing and possesses a first ring-shaped bearing surface for bearing against a housing of the compressor and a second ring-shaped bearing surface for bearing against a housing of the drive. According to disclosed embodiments, the compressor flange comprises, furthermore, axially and/or radially active seals for sealing off with respect to the compressor housing and/or to the shaft, so that an open compressor housing can be closed and sealed off, using the compressor flange. The seals form integral parts of the connecting flange, so that there is no need to use separate sealing means which have to be mounted separately from the flange component. The compressor flange therefore at the same time assumes the function of an end cover which is usually provided for closing and sealing off a screw-type compressor. That is to say, the compressor flange assumes not only the connecting function, but also a closing and seal-off function. The number of components required can therefore be reduced, so that the outlay in terms of manufacture and assembly is consequently also reduced.

The axially and/or radially active seals may be inserted in grooves on the compressor flange or may be injected-molded on or integrally formed. Sealing off with respect to the shaft may take place in the region of the shaft bearing, so that the seal is not exposed to any dynamic load. The seal therefore has a long service life.

Optionally, furthermore, there is provision for the compressor flange to possess an axially active seal for sealing off with respect to the housing of the drive. A leaktight connection of the screw-type compressor to the drive housing is thus also ensured.

Optionally, furthermore, an annular step is formed on at least one end face of the compressor flange for the purpose of centering the compressor flange with respect to the compressor housing, to the shaft, to the bearing and/or to the housing of the drive. The compressor flange thus has at the same time a centering function and makes it unnecessary to have further connecting elements, for example in the form of centering pins. An annular step for centering with respect to the compressor housing and to the drive may be formed on each of the two end faces of the compressor flange.

Advantageously, an axial extension for fixing the axial position of the bearing is formed on the end face facing the compressor housing. That is to say, after the connection of the compressor flange to the compressor housing, the axial extension is supported on a radially running surface of the bearing. Furthermore, the axial extension may be designed in such a way that it replaces a centering annular step arranged on the compressor side. For this purpose, the axial extension may be inserted into a recess formed on the compressor housing or on the bearing in such a way that the axial extension is supported not only axially, but also radially. The axial extension on the compressor flange thus fulfils a holding and a centering function.

Alternatively, the flange may also have an annular step in a form in which the latter receives the surface area of the shaft bearing and fixes the axial position of the latter. Centering of the flange on the bearing is thereby also achieved. The latter may be achieved in that the bearing end projects axially beyond the compressor housing or in that the compressor housing has a corresponding recess.

The compressor flange may be fastened to the compressor housing by means of screws. For this purpose, bores for receiving the screws are provided in the region of the first ring-shaped bearing surface for the bearing of the compressor flange against the compressor housing.

According to a disclosed embodiment, the compressor flange is of pot-shaped design and, when bearing against the compressor housing and against the housing of the drive, delimits a cavity for receiving a clutch which connects the shaft of the compressor to a shaft of the drive. By the clutch being housed by the compressor flange, it becomes possible to dispense with a clutch bell housing and therefore to use a simple clutch. The number of components can thus be reduced even further. Moreover, the space requirement decreases on account of the smaller overall construction size. Finally, weight can also be saved.

Furthermore, a reduction in the number of components is accompanied by a reduced outlay in terms of assembly, since fewer components have to be aligned with one another and fastened to one another. Moreover, the locations which additionally have to be sealed off are reduced. The adding-up of manufacturing and/or assembly tolerances is thereby also reliably avoided.

The seals provided on the compressor flange ensure, even when a clutch bell housing is dispensed with, that the clutch received in the cavity of the pot-shaped compressor flange is sufficiently protected. This protection can be ensured even when, for example, the screw-type compressor is in partially immersed operational use. Moreover, the cavity may serve for receiving a lubricating medium, since the seals of the compressor flange ensure that no lubricating medium escapes outward. Should a leakage of lubricant occur in the region of the shaft, the cavity of the pot-shaped compressor flange serves for capturing the lubricant which has emerged.

Optionally, the end face forms, in the region of the bottom of the pot-shaped compressor flange, the first ring-shaped bearing surface for the bearing of the compressor flange against the compressor housing. The cover function of the compressor flange can thus be implemented in a simple way. The central orifice for receiving the shaft is likewise provided in the region of the bottom of the pot-shaped compressor flange. Optionally, furthermore, the end face radially delimiting the cavity and lying opposite the bottom of the pot-shaped compressor flange forms the second ring-shaped bearing surface for the bearing of the compressor flange against the drive housing.

For the maintenance and/or bleeding of the screw-type compressor, the compressor flange may, furthermore, possess orifices, in particular maintenance and/or bleeding orifices. These are optionally designed in such a way that the sealing function of the compressor flange is still ensured.

To achieve the object, furthermore, a screw-type compressor having a compressor flange according to disclosed embodiments is proposed, the compressor flange serving at the same time as an end cover for closing and sealing off the compressor housing and as a connecting flange for connecting the compressor housing to the housing of the drive. In this case, the space enclosed by the compressor flange may be designed as an open or a closed compressor, depending on the requirements of the type of clutch used, on the type of shaft connection or on further requirements arising from the application.

The single FIGURE shows a detail of a screw-type compressor 2 in the region of connection to a drive 3, the connection being effected via a compressor flange 1. The compressor flange 1 combines a plurality of functions in one component, since it not only makes a connection between the compressor 2 and drive 3, but also at the same time, via annular steps 14, 15 formed on its end faces 16, 17, makes it possible to center the compressor 2 with respect to the drive 3. The compressor flange 1 at the same time replaces an end cover for closing and sealing off the housing 8 of the compressor 2 in that an axially active seal 11 is embedded in a first ring-shaped bearing surface 7 for the bearing of the compressor flange 1 against the compressor housing 8. Moreover, the compressor flange 1 seals off with respect to a shaft 5 of the compressor 2, said shaft being led through a central orifice 4 of the compressor flange 1. For this purpose, a radially active seal 12 is embedded in the compressor flange 1 in the region of the central orifice 4. The radially active seal 12 bears sealingly against a bearing 6 which is provided for mounting the shaft 5 of the compressor 2. Sealing off with respect to the shaft 5 of the compressor 2 therefore takes place indirectly via the bearing 6. The advantage of this is that the radially active seal 12 is not exposed to any dynamic load.

A further axially active seal 13 is provided in the end face 17 for sealing off the compressor flange 1 with respect to the housing 10 of the drive 3. Moreover, the end face 17 forms a second ring-shaped bearing surface 9 for the bearing of the compressor flange 1 against the housing 10 of the drive 3. To fix the compressor flange 1 to the compressor housing 8, screws 19 are provided which are led through bores in the end face 16 for the purpose of screwing the compressor flange 1 to the compressor housing 8. The screws 19 ensure axial prestressing of the compressor flange 1 with respect to the compressor housing 8, the axially active seal 11 also being pressed onto the compressor housing 8.

In the embodiment illustrated, the annular step 14 in the region of the end face 16 is designed as an axial extension 18, by means of which the bearing 6 is held in position. The compressor flange 1 thus fulfils, furthermore, a holding function, the holding of the bearing 6 being ensured by connection by means of the screws 19. For this purpose, the axial extension 18 engages positively into a ring-shaped recess of the compressor housing 8. Therefore, at the same time, this also gives rise via the axial extension 18 to centering of the compressor flange with respect to the compressor housing 8 and/or to the shaft 5 of the compressor 2.

Alternatively or additionally to the axial extension 18, moreover, an axial receptacle 23 for fixing the axial position of the bearing 6 may be formed in the compressor flange in the region of the end face 16. Advantageously, for this purpose, the bearing 6 is designed in such a way that it projects in the axial direction, so that it can at least partially be inserted (not illustrated) into the axial recess 23.

Furthermore, the compressor flange 1 of the embodiment illustrated is of pot-shaped design, so that, between a bottom region, which is secured axially to the compressor housing 8, and a side wall region, a cavity 20 is formed, which in the present case serves for receiving a clutch 21 for connecting the shaft 5 of the compressor 2 to the shaft 22 of the drive 3. The compressor flange 1 thus also assumes a protective function which makes it unnecessary to arrange a clutch bell housing. The seals 11, 13 in this case ensure that the cavity 20 formed between the compressor 2 and the drive 3 is sealed off outwardly.

The compressor flange, illustrated in the FIGURE, can thus combine within itself the functions of an end cover, of a flange and of a protective hood, while at the same time it assumes a centering, holding and sealing function. All these functions are implemented by a single component, so that the number of components required can be markedly reduced and the outlay in terms of manufacture and assembly can be markedly diminished. At the same time, the construction size and the weight of a screw-type compressor are reduced, and therefore the latter requires less construction space.

LIST OF REFERENCE SYMBOLS

1 Compressor flange
2 Compressor
3 Drive
4 Central orifice
5 Shaft of the compressor
6 Bearing
7 First ring-shaped bearing surface
8 Housing of the compressor
9 Second ring-shaped bearing surface
10 Housing of the drive
11 Axially active seal
12 Radially active seal
13 Axially active seal
14 Annular step
15 Annular step
16 End face
17 End face
18 Axial extension
19 Screws
20 Cavity
21 Clutch
22 Shaft of the drive
23 Receptacle

The invention claimed is:

1. A compressor flange for connecting a screw-type compressor to a drive, the compressor flange comprising:
- a central orifice for the reception of a shaft and/or bearing;
- a first ring-shaped bearing surface that bears against a housing of the screw-type compressor;
- a second ring-shaped bearing surface that bears against a housing of the drive, the second ring-shaped bearing surface parallel to the first ring-shaped bearing surface; and
- axially and radially active seals that seal off with respect to the compressor housing of the screw-type compressor and/or to the shaft, so that the compressor housing is closed and sealed off by the compressor flange,
- wherein the axially active seals are embedded in the parallel first and second ring-shaped bearing surfaces.

2. The compressor flange of claim 1, wherein an annular step is formed on at least one end face of the compressor flange for centering the compressor flange with respect to the compressor housing, to the shaft and/or to the housing of the drive.

3. The compressor flange of claim 1, further comprising an axial extension that fixes the axial position of the bearing and is formed on an end face facing the compressor housing.

4. The compressor flange of claim 1, further comprising an axial receptacle that fixes the axial position of the bearing and is formed on an end face facing the compressor housing.

5. The compressor flange of claim 1, wherein the compressor flange is configured to be fastened to the compressor housing by screws.

6. A compressor flange for connecting a screw-type compressor to a drive, the compressor flange comprising:
- a central orifice for the reception of a shaft and/or bearing;
- a first ring-shaped bearing surface that bears against a house housing of the screw-type compressor;
- a second ring-shaped bearing surface, parallel to the first ring-shaped bearing surface, that bears against a housing of the drive; and
- axially and/or radially active seals that seal off with respect to the compressor housing of the screw-type compressor and/or to the shaft, so that the compressor housing, when open, is closed and sealed off, using by the compressor flange,
- wherein axially active seals are embedded in parallel first and second ring-shaped bearing surfaces, and
- wherein the compressor flange is pot-shaped and, when bearing against the compressor housing at a bottom of the pot-shaped compressor flange and against the housing of the drive, delimits a cavity that receives a clutch which connects the shaft of the compressor to a shaft of the drive.

7. The compressor flange of claim 6, wherein an end face forms, in the region of the bottom of the pot-shaped compressor flange, the first ring-shaped bearing surface, and the end face radially delimiting the cavity and lying opposite the bottom forms the second ring-shaped bearing surface.

8. The compressor flange of claim 1, further comprising maintenance and/or bleeding orifices.

9. A screw-type compressor having a compressor flange for connecting the screw-type compressor to a drive, the compressor flange comprising:
- a central orifice for the reception of a shaft and a bearing;
- a first ring-shaped bearing surface that bears against a housing of the screw-type compressor;
- a second ring-shaped bearing surface that bears against a housing of the drive; and
- axially and radially active seals that seal off with respect to the compressor housing of the screw-type compressor and/or to the shaft, so that the compressor housing is closed and sealed off, by the compressor flange,
- wherein the compressor flange serving at the same time as an end cover for closing and sealing off the compressor housing and as a connecting flange for connecting the compressor housing to the housing of the drive,
- wherein the radially active seal located in the compressor flange bears sealingly against the bearing in the central orifice, and
- wherein the axially active seals are embedded in parallel surfaces of the first and second ring-shaped bearing surfaces.

10. The compressor flange of claim 6, wherein an annular step is formed on at least one end face of the compressor flange for centering the compressor flange with respect to the compressor housing, to the shaft and/or to the housing of the drive.

11. The compressor flange of claim 6, further comprising an axial extension that fixes the axial position of the bearing and is formed on an end face facing the compressor housing.

12. The compressor flange of claim 6, further comprising an axial receptacle that fixes the axial position of the bearing and is formed on an end face facing the compressor housing.

13. The compressor flange of claim 6, wherein the compressor flange is configured to be fastened to the compressor housing by screws.

14. The compressor flange of claim 9, wherein the axially active seals are embedded in the first and second ring-shaped bearing surfaces.

* * * * *